US009139029B2

(12) United States Patent
Hashimoto

(10) Patent No.: US 9,139,029 B2
(45) Date of Patent: Sep. 22, 2015

(54) INK RIBBON CASSETTE AND PRINTING APPARATUS

(71) Applicant: CANON KABUSHIKI KAISHA, Tokyo (JP)

(72) Inventor: Masaya Hashimoto, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/320,363

(22) Filed: Jun. 30, 2014

(65) Prior Publication Data

US 2015/0002602 A1 Jan. 1, 2015

(30) Foreign Application Priority Data

Jul. 1, 2013 (JP) ..... 2013-138334

(51) Int. Cl.

| | |
|---|---|
| ***B41J 17/30*** | (2006.01) |
| ***B41J 35/04*** | (2006.01) |
| ***B41J 35/06*** | (2006.01) |
| ***B41J 2/325*** | (2006.01) |
| ***B41J 17/32*** | (2006.01) |

(52) U.S. Cl.

CPC *B41J 17/30* (2013.01); *B41J 2/325* (2013.01); *B41J 17/32* (2013.01); *B41J 35/04* (2013.01); *B41J 35/06* (2013.01)

(58) Field of Classification Search

CPC ..... B41J 17/30; B41J 35/04; B41J 35/06; B41J 35/08; B41J 17/32

See application file for complete search history.

(56) References Cited

U.S. PATENT DOCUMENTS 7,246,962 B2 * 7/2007 James, III et al. ..... 400/636

FOREIGN PATENT DOCUMENTS

| | | | | | |
|---|---|---|---|---|---|
| JP | 2-178074 | A | | 7/1990 | |
| JP | 08332765 | A | * | 12/1996 | ..... B41J 35/04 |
| JP | 09039349 | A | * | 2/1997 | ..... B41J 35/04 |
| JP | 2010105243 | A | * | 5/2010 | ..... B41J 17/30 |

* cited by examiner

*Primary Examiner* — Daniel J Colilla

(74) *Attorney, Agent, or Firm* — Canon U.S.A., Inc. IP Division

(57) ABSTRACT

An ink ribbon cassette and printing apparatus capable of stably conveying an ink ribbon includes a supply shaft around which an ink ribbon is wound, a rewinding shaft around which the ink ribbon from the supply shaft is to be rewound, a guide shaft configured to abut the ink ribbon on a conveying path of the ink ribbon from the supply shaft to the rewinding shaft, and a regulation portion configured to abut the guide shaft according to a force applied to the guide shaft by the ink ribbon, thereby deforming the guide shaft to protrude toward the ink ribbon.

26 Claims, 12 Drawing Sheets

INK RIBBON CASSETTE AND PRINTING APPARATUS

BACKGROUND OF THE INVENTION

1. Field of the Invention

The present invention relates to an ink ribbon cassette for storing an ink ribbon and a printing apparatus.

2. Description of the Related Art

In recent years, printing apparatuses have been widely used with which a photographic print can be easily acquired from image data obtained by using a digital camera. A thermal transfer printing apparatus using a thermal head is known as one of these printing apparatuses. A thermal transfer recording method using a thermal head causes a thermal head and a platen roller to convey an ink ribbon made of a long film, and a recording sheet while nipping the ink ribbon and the recording sheet, thereby performing printing. The ink ribbon is formed by applying dyes (inks) to the long film. On the thermal head, a plurality of heating elements (resistive elements) is arranged in a line. By selectively energizing these heating elements, the dyes applied to the ink ribbon are transferred onto the recording sheet, thereby performing the printing.

In such a thermal transfer printing apparatus, if the ink ribbon is not stably conveyed, wrinkles are generated in the ink ribbon. If wrinkles are generated in the ink ribbon, color loss occurs when printing is performed. To address this problem, in Japanese Patent Application Laid-Open No. 2-178074, a rotating shaft deformed into an arcuate shape is brought into contact with an ink ribbon, thereby generating a force that stretches the ink ribbon in the width direction. The force can prevent the generation of wrinkles in the ink ribbon.

If, however, the rotating shaft is used by deforming the rotating shaft into an arcuate shape, the shaft needs to be rotatably held while maintaining the arcuate deformation. Thus, the stress caused by the deformation of the shaft is constantly applied to shaft reception portions. Further, if an ink ribbon is conveyed without applying high tension to the ink ribbon, the ink ribbon is conveyed in such a manner that only the vicinity of the center of the rotating shaft is deformed to have an arcuate shape and comes into contact with the ink ribbon, while both ends of the ink ribbon in the width direction are not in contact with the rotating shaft. This also creates a new problem in that an imbalance in the tension applied to the ribbon in the width direction is likely to generate wrinkles.

SUMMARY OF THE INVENTION

According to an aspect of the present invention, an ink ribbon cassette includes a supply shaft around which an ink ribbon is wound, a rewinding shaft around which the ink ribbon from the supply shaft is to be rewound, a guide shaft configured to abut the ink ribbon on a conveying path of the ink ribbon from the supply shaft to the rewinding shaft, and a regulation portion configured to abut the guide shaft according to a force applied to the guide shaft by the ink ribbon, thereby deforming the guide shaft to protrude toward the ink ribbon side.

Further features of the present invention will become apparent from the following description of exemplary embodiments with reference to the attached drawings.

DESCRIPTION OF THE EMBODIMENTS

Figure 1:
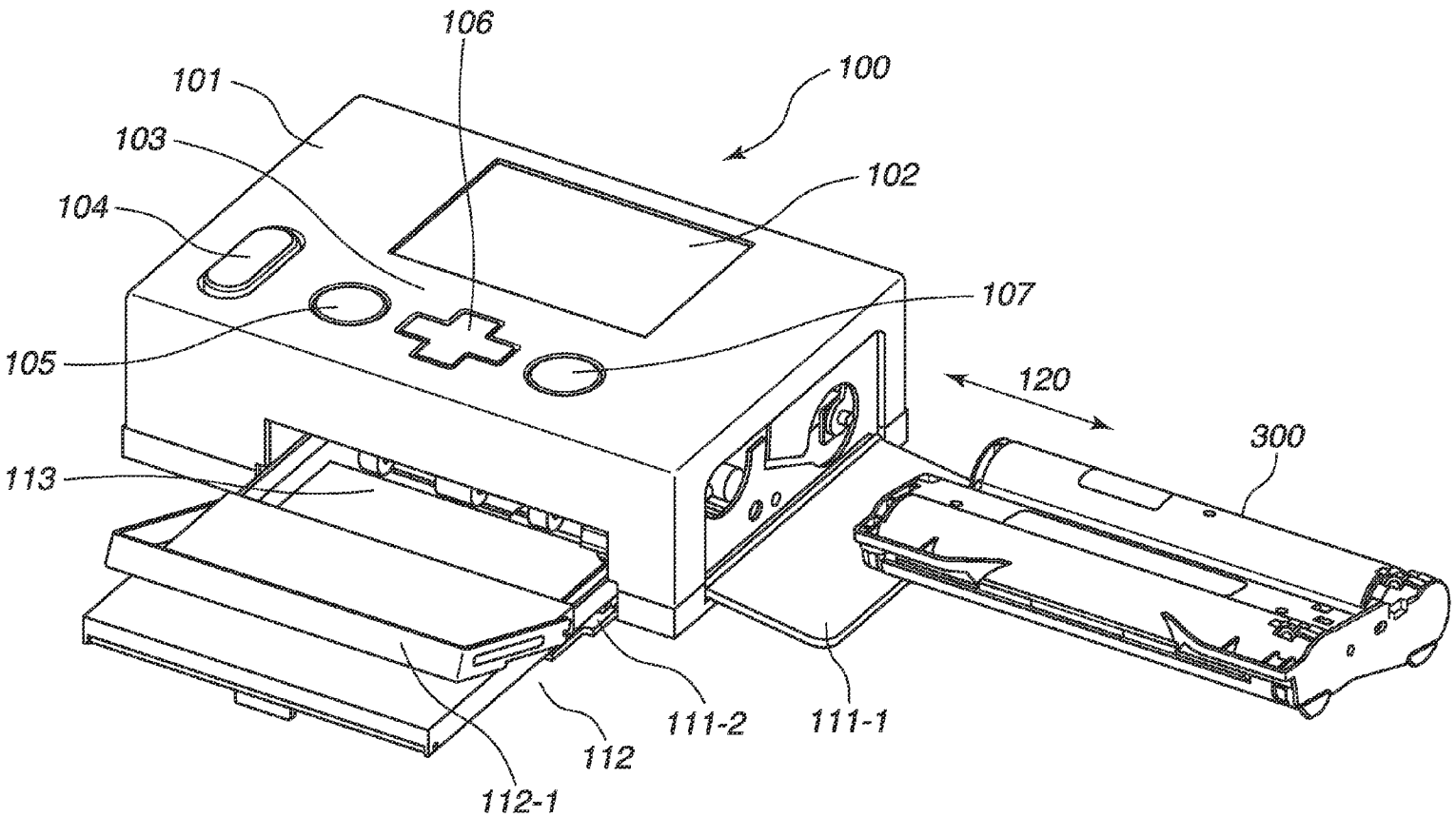
FIG. 1 is a diagram illustrating the external configurations of a printing apparatus and an ink ribbon cassette used in the printing apparatus, according to the present invention.

Various exemplary embodiments, features, and aspects of the invention will be described in detail below with reference to the drawings.

In the following description, "printing" refers to an entire operation including a series of processes from photographic printing based on a print instruction given by a user to the discharge of a sheet serving as a photographic printing medium. Further, "photographic printing" refers to, in the printing operation, the process of thermally transferring inks applied to an ink ribbon onto a photographic print sheet serving as a photographic printing medium, thereby recording an image on the photographic print sheet.

A thermal transfer recording printing apparatus for performing full-color printing is configured to deposit three colors which are sequentially applied to an ink ribbon, namely yellow (Y), magenta (M), and cyan (C), one on top of another to perform printing, thereby generating a full-color photographic print. Such a thermal transfer printing apparatus also transfers onto a photographically printed image an overcoat ink applied in advance to the ink ribbon, for the protection of a photographically printed image, thereby forming an overcoat layer on the image formed on a recording sheet.

The ink ribbon is generally configured such that yellow, magenta, and cyan dye inks and an overcoat layer, which contains an acrylic resin as the main ingredient, are respectively formed on a base film made of polyester. The dye ink is formed by applying an ink to the base film and drying the ink. The ink is obtained by dissolving a mixture of a dye, which is a color material, and a synthetic resin termed a binder, in an appropriate solvent.

One end of the ink ribbon is fixed to a cylindrical shaft longer than the width of the ink ribbon, and then, the ink ribbon is wound around the cylindrical shaft. The other end is fixed to another cylindrical shaft. Then, the positions of both shafts are regulated such that both shafts are rotatably movable and placed at a predetermined distance from each other. Then, both shafts are installed within an exterior case. The product is supplied as an ink ribbon cassette. Thus, an operation is facilitated when the user exchanges the ink ribbon, which is a consumable item. Further, the ink ribbon on a thin film is prevented from being damaged.

There is a great need for downsizing of such a printing apparatus in terms of portability and handleability. To downsize the entire printing apparatus, generally, the conveying path of the ink ribbon is curved to gain high space efficiency. Further, to the surface of the recording sheet used in the thermal transfer printing apparatus, a polyethylene terephthalate film or a polypropylene film is bonded. The polyethylene terephthalate or polypropylene film contains minute air, functions as a thermal insulating material and is bonded to natural paper serving as a base. A polymer having high dye receptivity is dissolved in an appropriate solvent and applied to the polyethylene terephthalate film or the polypropylene film, thereby forming an absorbing layer.

The thermal transfer recording printing apparatus causes a thermal head and a platen roller located at a position opposed to the thermal head, to convey the ink ribbon and the recording sheet while nipping the ink ribbon and the recording sheet. Then, the printing apparatus brings the ink ribbon and the recording sheet into pressure contact with the thermal head and selectively supplies electric power to heating elements arranged in a line on the thermal head, thereby generating heat. The printing apparatus diffusively transfers the dyes (inks) of the ink ribbon onto the absorbing layer on the surface of the photographic printing medium. The ink ribbon which has transferred the dyes onto the absorbing layer on the surface of the photographic printing medium sticks to the photographic print sheet. However, after a predetermined cooling time for fixing the dyes on the absorbing layer of the photographic print sheet lapses, the ink ribbon is peeled off by a mechanism for conveying a sheet and an ink ribbon, which is provided in the printer, thereby completing photographic printing. In the photographic printing, the thermal head provides a large amount of heat to the ink ribbon and the photographic print sheet. Thus, the higher the gradation, the more damaged the ink ribbon becomes from thermal contraction caused by heat applied from the thermal head. Further, the higher the gradation an area is, the greater the sticking force between the ink ribbon and the surface of the photographic print sheet in the area, and the more damaged the ink ribbon is when peeled off. It is known that the surface of the ink ribbon subjected to such damage becomes twisted, and wrinkles occur and cause color loss.

Further, when the photographic printing is performed, the ink ribbon and the photographic print sheet are conveyed being nipped by the thermal head and the platen roller. Thus, great tension is applied to the ink ribbon. Further, the ink ribbon is conveyed also when it is not being nipped by the thermal head and the platen roller. The tension applied to the ink ribbon varies depending on whether or not the ink ribbon is nipped by the thermal head and the platen roller. Further, the tension applied to the ink ribbon also varies depending on the remaining amount of the ink ribbon. Under any circumstances, wrinkles occur if the ink ribbon is not stably conveyed.

Therefore, a printing apparatus according to the present exemplary embodiment has the following configuration to stably convey an ink ribbon even if the tension applied to the ink ribbon varies.

With reference to FIGS. 1 to 12B, the printing apparatus according to the present exemplary embodiment is described below.

FIG. 1 is a diagram illustrating the external configurations of a printing apparatus 100 and an ink ribbon cassette 300 used in the printing apparatus 100, according to the present exemplary embodiment.

As illustrated in FIG. 1, the printing apparatus 100 includes a cassette cover 111-1, which is supported openable and closable on the side surface of the printing apparatus 100, so that the ink ribbon cassette 300 is attachable to and detachable from the printing apparatus 100 in the directions indicated by an arrow 120. In an upper portion of a case 101, a display unit 102 and an operation unit 103, which includes various buttons, are provided. Further, the printing apparatus 100 includes interfaces such as a Universal Serial Bus (USB) terminal and a Secure Digital (SD) card connector (not illustrated), so that an SD card having image data can be attached to the printing apparatus 100 and the printing apparatus 100 can connect to an external memory device through a USB cable, to receive image data.

The display unit 102 includes a display means such as a liquid crystal display (LCD). The display unit 102 displays image data to be printed and menus for inputting setting data necessary for printing.

The operation unit 103 includes an electric power button 104 for giving an instruction to turn on or off the electric power source of the printing apparatus 100, and a selection button 105 for selecting various menus displayed on the display unit 102. Near the selection button 105, an up, down, left, and right button 106 for moving a cursor displayed on the display unit 102 to a desired position, and a print button 107 are provided. If the user has selected a desired image using the up, down, left, and right button 106 and pressed the print button 107, the printing apparatus 100 starts printing.

The ink ribbon cassette 300 stores an ink ribbon 114, which is coated with sublimation ink. The ink ribbon 114 is conveyed driven by a power source provided in the printing apparatus 100 and is used for photographic printing. The details of the structure of the ink ribbon cassette 300 will be described later. On the front surface of the printing apparatus 100, a tray cover 111-2 is provided, which is pivotally supported to be openable and closable, so that when the tray cover 111-2 is opened, a sheet tray 112 can be attached to the printing apparatus 100.

In the sheet tray 112, photographic print sheets 113 cut to a prescribed size are set in advance by the user. When printing is performed, a sheet feeding mechanism provided in the printing apparatus 100 pulls only one photographic print sheet 113 out of the sheet tray 112. Then, a thermal head of the printing apparatus 100 transfers inks of colors, namely yellow (Y), cyan (C), and magenta (M), and a colorless and transparent overcoat (OC) for protecting a printed surface which are coated by the ink ribbon 114, thereby performing full-color photographic printing. A tray top cover 112-1 is rotatably supported by the sheet tray 112. When the sheet tray 112 is to be attached to the printing apparatus 100, the tray top cover 112-1 is rotated in an opening direction in advance by the user. When attached to the printing apparatus 100, the tray top cover 112-1 has the function of stacking the photographic print sheets 113 discharged from the printing apparatus 100 after the completion of the photographic printing.

Figure 2:
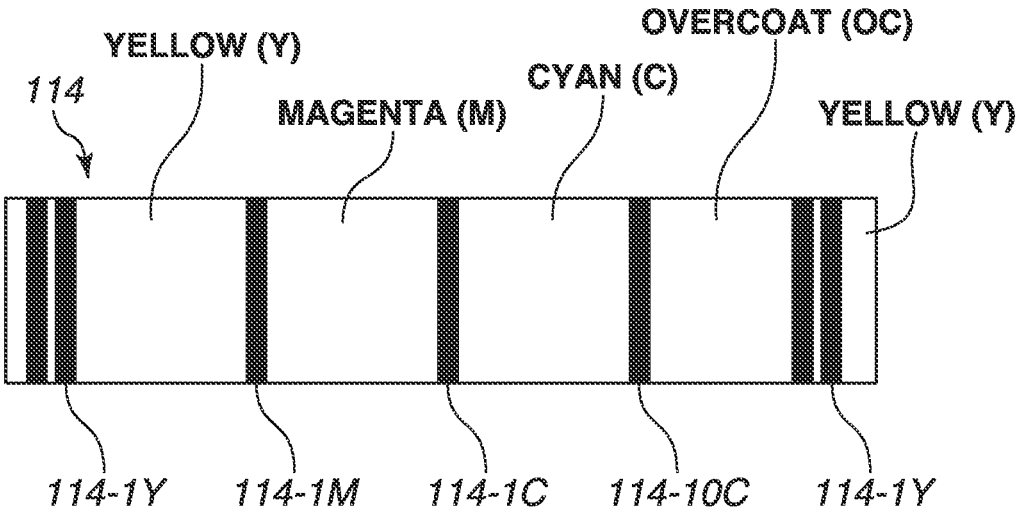
FIG. 2 is a development view of an ink ribbon.

Next, with reference to FIG. 2, the configuration of the ink ribbon 114 is described. FIG. 2 is a development view of the ink ribbon 114 according to the exemplary embodiment of the present invention. In the full-color printing as described above, generally, in the ink ribbon 114, yellow (Y), magenta (M), and cyan (C) are arranged, and the colors are deposited on a photographic print sheet one on top of another to perform photographic printing, thereby forming a full-color image. After yellow (Y), magenta (M), and cyan (C) have been printed to form the full-color image, to further protect the printed surface, a colorless and transparent overcoat (OC) layer is provided in the ink ribbon 114 following the color inks. The overcoat is applied on the entire surface of the full-color image formed by printing the color inks of yellow (Y), magenta (M), and cyan (C). Between the colors arranged in the ink ribbon 114, markings 114-1 are provided, which are printed black bands for detecting the positions of the leading ends of the respective colors. To indicate the leading end of the yellow (Y), two markings are provided to distinguish yellow (Y) from the other colors. The sublimation ink ribbon according to the present exemplary embodiment uses as a base a film having high heat resistance, such as a polyethylene terephthalate film having a thickness of two to a dozen or so micrometers. Each of the colors, namely yellow (Y), magenta (M), and cyan (C), is formed by applying a sublimation ink to the film in a thickness of about 0.2 to 5 μm. The sublimation ink is prepared by mixing a dye with a binder, a plasticizing agent, or a binding agent. The colorless and transparent overcoat layer is formed by applying a styrene derivative, a styrene resin, a styrene copolymer resin, or a binder to the film, in a thickness of about 0.5 to 5 μm. Further, a lubricant and an abrasive are applied to the surface opposite to the surface to which the inks are applied. The lubricant reduces the frictional resistance to a sliding portion to stabilize the running of the ink ribbon 114. The abrasive polishes and cleans the surface of the thermal head.

Next, with reference to FIGS. 3A to 5, the printing operation of the printing apparatus 100 is described.

Figure 3A:
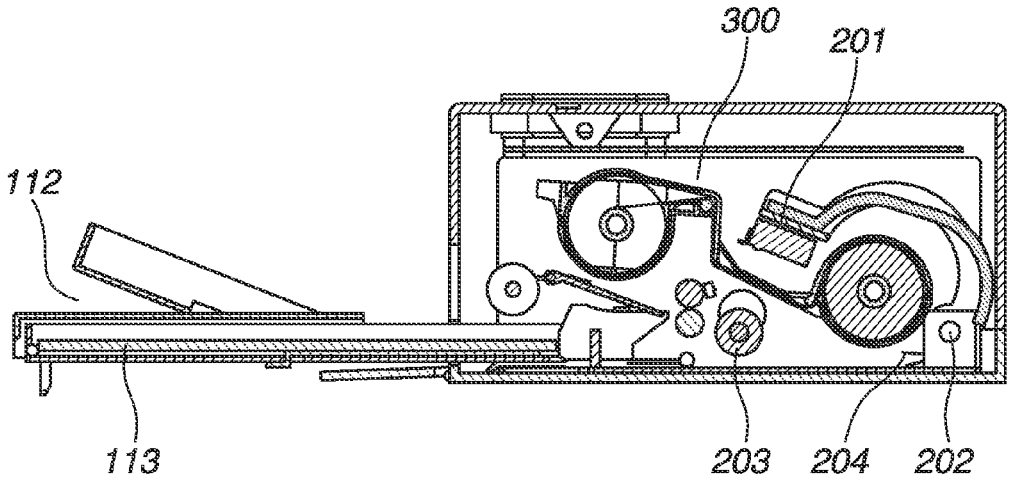
FIGS. 3A and 3B are cross-sectional views illustrating the operation of the printing apparatus.
Figure 3B:
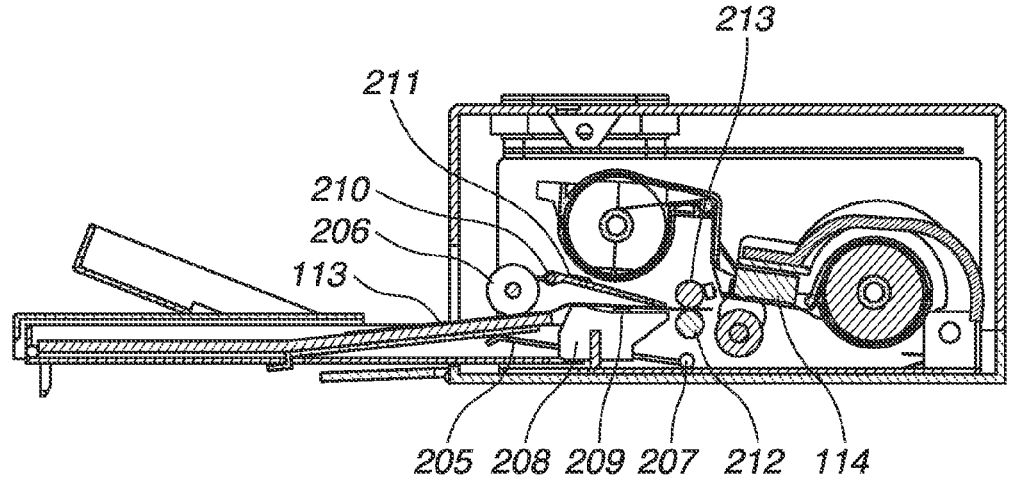
Figure 4A:
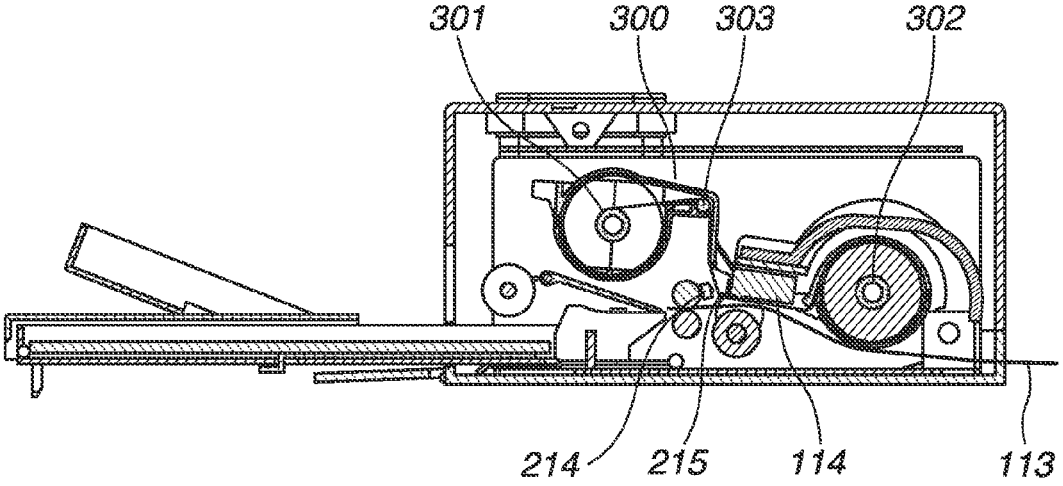
FIGS. 4A and 4B are cross-sectional views illustrating the operation of the printing apparatus.
Figure 4B:
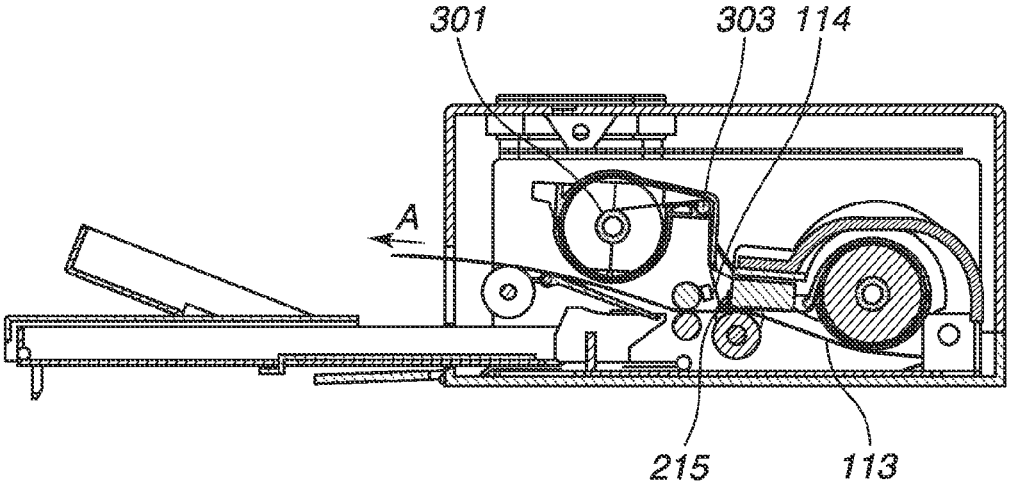
Figure 5:
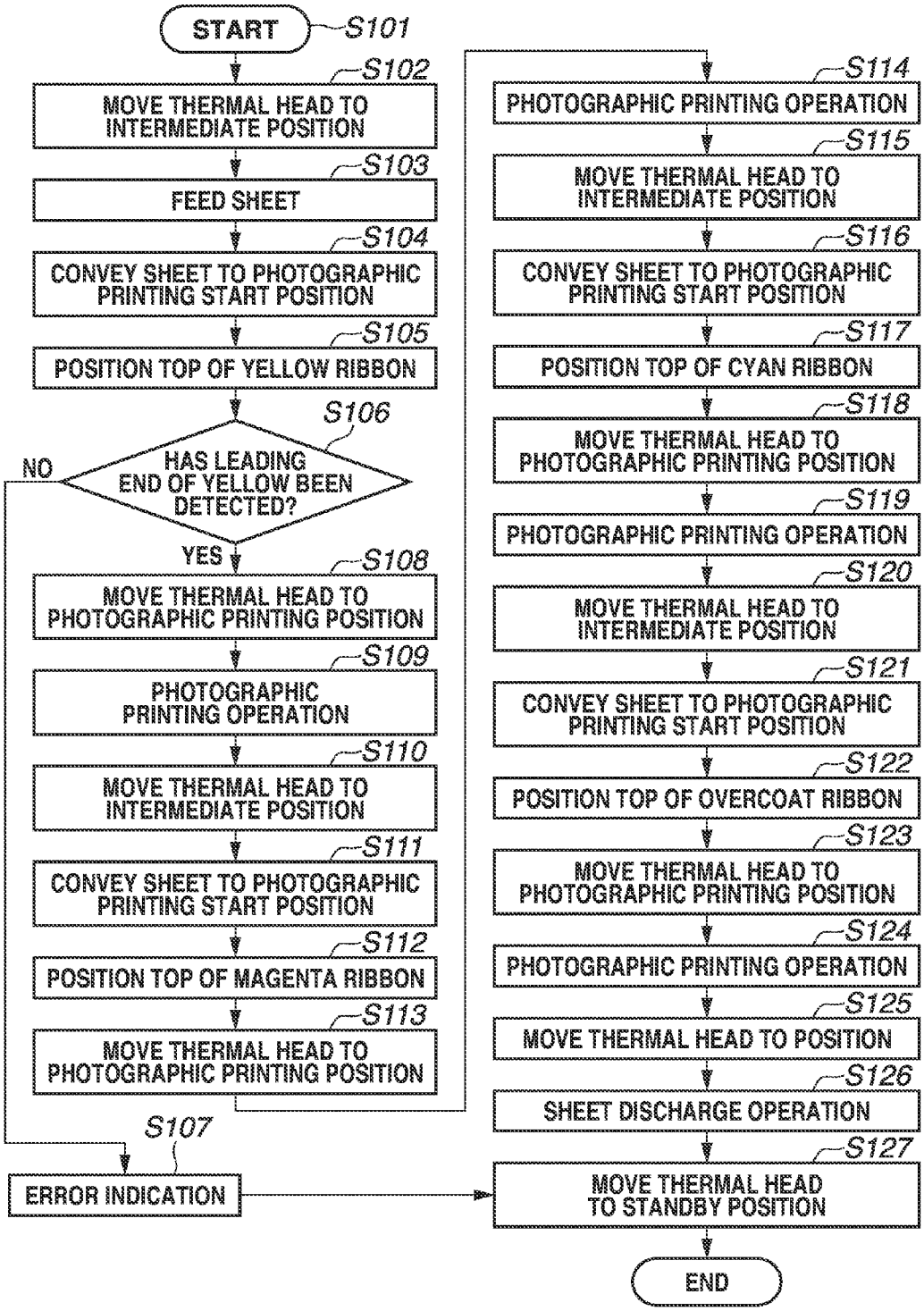
FIG. 5 is a flow chart illustrating the printing operation of the printing apparatus.

FIGS. 3A to 4B are cross-sectional views illustrating the operation of the printing apparatus 100. FIG. 5 is a flow chart illustrating the printing operation. FIG. 3A illustrates a photographic printing standby state. FIG. 3B illustrates a sheet feeding state. FIG. 4A illustrates positioning of a top of the ink ribbon 114. FIG. 4B illustrates an apparatus state during a photographic printing operation. As illustrated in FIG. 3A, if the user attaches to the printing apparatus 100 the ink ribbon cassette 300 and the sheet tray 112 in which the print sheets 113 are set, and presses the electric power button 104, the printing apparatus 100 enters a standby state. Image data supplied from an SD card (not illustrated) is read by the printing apparatus 100 and displayed on the display unit 102. Then, the user specifies image data to be printed using the selection button 105 and the up, down, left, and right button 106. The printing apparatus 100 includes a platen roller 203 and a thermal head 201. The thermal head 201 is rotatably supported by a thermal head rotation shaft 202 and is urged in a clockwise direction in FIG. 3A by a coil spring 204. In the photographic printing standby state, the thermal head 201 is rotated clockwise in FIG. 3A by the urging force of the coil spring 204 so as not to interfere with the ink ribbon cassette 300 when the ink ribbon cassette 300 is inserted or removed. Further, the position of the thermal head 201 is regulated so as to maximize the distance between the thermal head 201 and the platen roller 203.

Next, if the user has pressed the print button 107, the printing apparatus 100 starts the printing operation (step S101). When the printing operation is started, the thermal head 201 included in the printing apparatus 100 rotates counterclockwise in FIG. 3A about the thermal head rotation shaft 202 against the urging force of the coil spring 204 driven by a source of power (not illustrated). Then, as illustrated in FIG. 3B, the thermal head 201 moves to an intermediate position between the standby position and a printing position where the thermal head 201 and the platen roller 203 nip a print sheet (step S102). When the movement of the thermal head 201 is completed, the printing apparatus 100 starts a sheet feeding operation (step S103). If the sheet feeding operation has been started, a pressure plate 205 included in the printing apparatus 100 rotates clockwise in FIG. 3B about a pressure plate rotation shaft 207 powered by drive force (not illustrated) and presses up the print sheets 113 stacked in the sheet tray 112, against a sheet feeding roller 206. The sheet feeding roller 206 rotates in the counterclockwise direction in FIG. 3B powered by the drive force (not illustrated) and conveys the stacked print sheets 113 into the printing apparatus 100. The print sheets 113 abut on a separation plate 208 included in the printing apparatus 100, thereby conveying only the top of the stacked print sheets 113. Subsequently, the conveyed print sheet 113 is detected by a sheet detection sensor 209, which confirms that there is no failure in the sheet feeding operation. If it has been confirmed that there is no failure in the sheet feeding operation, the pressure plate 205 rotates to the position for standby illustrated in FIG. 3A powered by the drive force (not illustrated) so that the sheets in the sheet tray 112 are not erroneously conveyed into the printing apparatus 100. Subsequently, the print sheet 113 conveyed by the sheet feeding roller 206 presses a switching plate 211, which is rotatably supported by a switching plate rotation shaft 210, thereby rotating the switching plate 211 in the counterclockwise direction in FIG. 3B. Then, the print sheet 113 enters a nip portion between a conveyance roller 212 and a driven conveyance roller 213. On the conveyance roller 212, a plurality of minute projections that get stuck in the back surface of the print sheet 113 are formed so that the conveyance roller 212 can accurately convey the print sheet 113. Further, the conveyance roller 212 is driven by a stepper motor (not illustrated), thereby enabling the accurate control of the feeding amount. The print sheet 113 continues to be conveyed by the conveyance roller 212 and the driven conveyance roller 213. Then, after the trailing edge of the print sheet 113 has passed through the sheet detection sensor 209, the print sheet 113 is conveyed by a predetermined amount and stops at a photographic printing start position (step S104). If the sheet feeding operation has been completed and the print sheet 113 has stopped at the photographic printing start position, the operation of the positioning of the top of yellow (Y) of the ink ribbon 114 is performed (step S105). The ribbon top positioning operation is described below.

If the print sheet 113 has been conveyed to the position illustrated in FIG. 4A and the conveyance of the print sheet 113 to the photographic printing start position has been completed, the ink ribbon 114 stored in the ink ribbon cassette 300 becomes wound up. That is, the extremities of a rewinding shaft 301 provided in the ink ribbon cassette 300 are engaged with engagement portions included in the printing apparatus 100, and the rewinding shaft 301 is rotated counterclockwise in FIG. 4A powered by the drive force (not illustrated). Thus, the ink ribbon 114 wound around a supply shaft 302 becomes rewound around the rewinding shaft 301. As illustrated in FIG. 2, a black band is provided at the leading end of each color in the ink ribbon 114. Particularly, two black bands are provided at the leading end of yellow (Y). The printing apparatus 100 includes an ink ribbon sensor 214, which is a reflective optical sensor. The ink ribbon sensor 214 detects that reflected light is blocked by each black band provided in the ink ribbon 114. Thus, the printing apparatus 100 stops the conveyance of the ink ribbon 114 and positions a top of the corresponding color of the ink ribbon 114. When positioning a top of yellow (Y), the printing apparatus 100 determines whether or not the two black bands can be detected (step S106). When the operation of positioning the top of yellow (Y) is performed, if one of the black bands has not been detected, or if the black bands have not been detected within a prescribed time (NO in step S106), the printing apparatus 100 gives an error indication on the display unit 102 to indicate an abnormality of the ink ribbon cassette 300 (step S107) and moves the thermal head 201 to the standby position illustrated in FIG. 3A (step S127). Then, the printing apparatus 100 ends the printing operation.

FIG. 4A illustrates the state immediately after the beginning of use of a new ink ribbon cassette 300. Thus, the amount of the ink ribbon 114 wound around the supply shaft 302 enables the photographic printing of a prescribed number of sheets. If the ink ribbon 114 has already been used for the photographic printing of nearly the prescribed number of sheets, a large portion of the ink ribbon 114 is wound around the rewinding shaft 301, and the diameter of the ink ribbon 114 on the rewinding shaft 301 side, where the ink ribbon 114 is rewound around the rewinding shaft 301, increases by the amount of the already rewound ink ribbon 114. Thus, the tension applied to the ink ribbon 114 by a mechanism for rotating the rewinding shaft 301, which is included in the printing apparatus 100, decreases as the photographic printing proceeds.

If the positioning the top of yellow (Y) has been completed (YES in step S106), the thermal head 201 rotates counterclockwise in FIG. 4A about the thermal head rotational movement shaft 202 and moves to the position where the thermal head 201 and the platen roller 203 nip the ink ribbon 114 and the print sheet 113 (step S108). If the movement of the thermal head 201 to a photographic printing position has been completed, then as illustrated in FIG. 4B, the print sheet 113 and the ink ribbon 114 are conveyed in the direction indicated by an arrow A in FIG. 4B, while remaining nipped by the thermal head 201 and the platen roller 203. While conveyed, the ink ribbon 114 is heated by the thermal head 201, and the inks coated on the ink ribbon 114 are transferred onto the print sheet 113, thereby performing photographic printing (step S109). As described above, during the photographic printing operation, the ink ribbon 114 and the print sheet 113 are conveyed at the same speed. Thus, a torque limiter mechanism (not illustrated), which slips if load equal to or greater than a predetermined torque has been applied thereto, is built into an ink ribbon conveying mechanism included in the printing apparatus 100. If the printing has been finished by the heating of the thermal head 201, the ink ribbon 114 and the print sheet 113 are conveyed while maintaining a close contact state a predetermined distance, and then are conveyed in the directions of separating from each other. More specifically, the print sheet 113 is conveyed in the direction of the arrow A by the conveyance roller 212, and the ink ribbon 114 is conveyed toward a guide shaft 303, which is provided in the ink ribbon cassette 300, while sliding in contact with a peel-off plate 215, which is integrated with the thermal head 201. The ink ribbon 114 having stuck to the print sheet 113 due to the heating of the thermal head 201 for the photographic printing is conveyed to the position of the peel-off plate 215 and peeled off from the print sheet 113. If an image to be printed has a high gradation, high density is required. Thus, a large amount of heat is provided by the thermal head 201 to diffusively move more dye to the print sheet 113. Consequently, the ink ribbon 114 is more damaged in a high density area than in a mid-to-low gradation area. This is likely to cause twists and wrinkles. If twists and wrinkles have occurred, color loss appears. This leads to a reduction in the photographic printing quality. The distance between the peel-off plate 215 and heating elements provided on the thermal head 201 is appropriately set to a value required to sufficiently cool and fix the dye having diffusively moved from the ink ribbon 114 to the print sheet 113.

If the photographic printing of the photographic printing area of a yellow image on the print sheet 113 has been completed, the power (not illustrated) provided in the printing apparatus 100 carries out drive to rotate the thermal head 201 and retract the thermal head 201 to the position illustrated in FIG. 4A (step S110). Then, the print sheet 113 is conveyed in the direction opposite to the photographic printing operation up to the position illustrated in FIG. 4A (i.e., to the photographic printing start position) (step S111).

Then, similarly to the photographic printing operation of yellow (Y), a marker 114-1M is detected, and the ink ribbon 114 is conveyed to the photographic printing start position and stopped, thereby performing the photographic printing of magenta (M) (steps S112 to S116). Similarly, markers 114C and 1140C are detected, and the top of the ribbon are positioned, thereby performing the photographic printing of cyan (C) and the overcoat (OC) (steps S117 to S125). If the photographic printing of the overcoat (OC) has been completed, the print sheet 113 is further conveyed in the direction indicated by the arrow A in FIG. 4B. After the back end of the sheet 113 has passed through the conveyance roller 212, the sheet 113 is discharged onto the sheet tray 112, outside the printing apparatus 100, by the conveying force of the sheet feeding roller 206 (step S126). If the discharge of the sheet 113 has been completed, the thermal head 201 is rotated to the standby position powered by the drive force (not illustrated), and the printing is ended.

This completes the photographic printing operation for placing the inks of yellow, magenta, cyan, and the overcoat layer one on top of another in this order to transfer the inks.

Figure 6A:
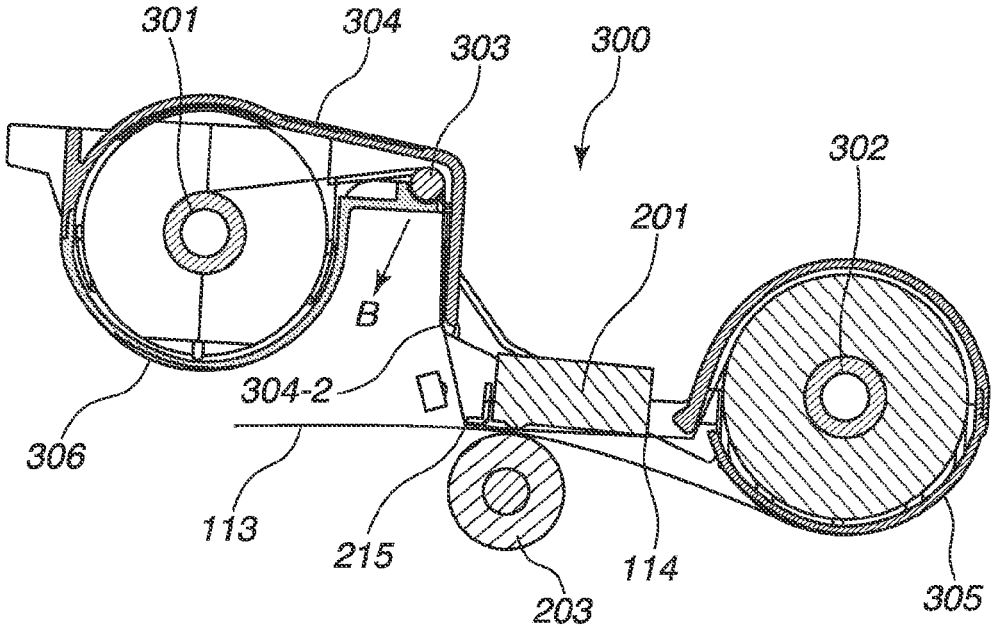
FIGS. 6A and 6B are cross-sectional views of the conveying path of the ink ribbon in the printing apparatus.

Next, with reference to FIGS. 6A to 7B, the behavior of the ink ribbon 114 is described. FIGS. 6A to 7B are cross-sectional views of the conveying path of the ink ribbon 114 in various states. FIG. 6A is a cross-sectional view of a photographic printing state using the ink ribbon cassette 300 in the early period of photographic printing. As described above, the ink ribbon conveying mechanism (not illustrated) included in the printing apparatus 100 rotates the rewinding shaft 301 provided in the ink ribbon cassette 300 counterclockwise in FIG. 6A. As described above, during the photographic printing operation, the ink ribbon 114 and the print sheet 113 are nipped together between the platen roller 203 and the thermal head 201 and conveyed at the same speed. Further, the ink ribbon 114 after the photographic printing is peeled off from the print sheet 113 by the peel-off plate 215. In FIGS. 6A and 6B, the rewinding shaft 301 is included in the ink ribbon cassette 300 in the early period of photographic printing. Thus, the amount of the rewound ink ribbon 114 is small, and the shaft diameter of the ink ribbon 114 on the rewinding shaft 301 side is small. Since the shaft diameter of the ink ribbon 114 on the rewinding shaft 301 side is thus small, the tension caused by the rewinding shaft 301 is great. Further, since the ink ribbon 114 is nipped between the thermal head 201 and the platen roller 203 and subjected to the peel-off operation, the conveyance load is great. As described above, the tension of rewinding the ink ribbon 114 downstream of the thermal head 201 is great, and the conveyance load is great. Thus, the tension applied to the ink ribbon 114 is very great. Downstream of the thermal head 201, the ink ribbon 114 is conveyed while sliding in contact with a rewinding-side sliding portion 304-2 of a cassette case 304 and the peel-off plate 215. If the tension applied to the ink ribbon 114 is great, stress occurs in the portions of the conveying path that slide in contact with the ink ribbon 114. It is, however, easy to provide the peel-off plate 215 and the rewinding-side sliding portion 304-2 with relatively strong structures. Thus, great force is also applied to the guide shaft 303, which is provided to sharply change the conveying direction on the rewinding side and abuts on the ink ribbon 114. More specifically, stress is applied to deform the guide shaft 303 in the direction indicated by an arrow B in FIG. 6A. The guide shaft 303 is formed of an elastic member that is elastically deformable, such as a resin. Thus, the application of great force to the guide shaft 303 deforms the guide shaft 303. To curve the conveying path of the ink ribbon 114, the guide shaft 303 is provided in the ink ribbon cassette 300 to abut on the ink ribbon 114. The apparatus is configured in the above mentioned way to place between the thermal head 201 and the ink ribbon cassette 300 the conveyance roller 212 and the conveyance driven roller 213, which serve as a sheet conveying mechanism, and a mechanism for holding these rollers, thereby downsizing the printing apparatus 100.

Figure 6B:
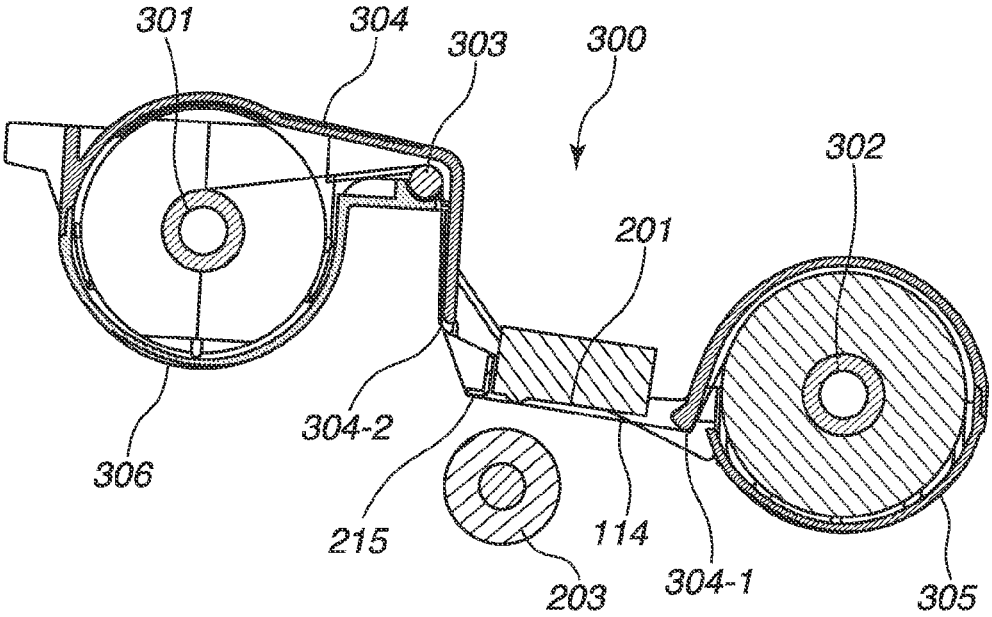

FIG. 6B is a cross-sectional view of the state where a top of the ribbon is positioned using the ink ribbon cassette 300 in the early period of photographic printing. As described above, when the operation of positioning the top of each color of the ink ribbon 114 is performed, the ink ribbon 114 is not nipped between the thermal head 201 and the platen roller 203. Further, as illustrated in FIG. 6B, the thermal head 201 is located at the intermediate position, and therefore, the conveying path of the ink ribbon 114 is not as sharply curved at the peel-off plate 215 as in the photographic printing state. Further, the conveyance resistance to the ink ribbon 114 is caused only by dynamic friction that occurs in a supply-side sliding portion 304-1, the rewinding-side sliding portion 304-2, the thermal head 201, and the peel-off plate 215, which slide in contact with the ink ribbon 114. That is, the load is very small for the rewinding shaft 301. Since the load is small, the tension applied to the ink ribbon 114 is small. Therefore, the stress applied to the portions on the conveying path of the ink ribbon 114 that slide in contact with the ink ribbon 114 is small.

Figure 7A:
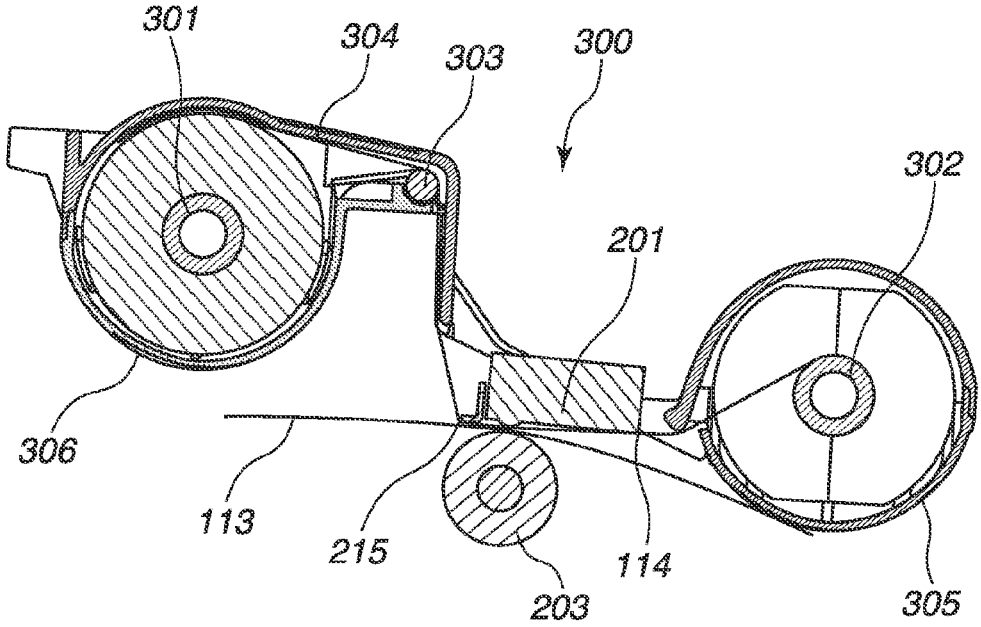
FIGS. 7A and 7B are cross-sectional views of the conveying path of the ink ribbon in the printing apparatus.

FIG. 7A is a cross-sectional view of a photographic printing state using the ink ribbon cassette 300 in the final period of use. The portion of the ink ribbon 114 that has already been used for photographic printing is rewound around the rewinding shaft 301. Accordingly, the shaft diameter of the ink ribbon 114 on the rewinding shaft 301 side is large, and therefore, the tension applied to the ink ribbon 114 is relatively small. Since the shaft diameter of the ink ribbon 114 on the rewinding shaft 301 side is large, the speed of conveying the ink ribbon 114 becomes faster. As described above, however, during the photographic printing, the ink ribbon 114 and the print sheet 113 are conveyed together between the thermal head 201 and the platen roller 203 at the same speed. Thus, the torque limiter (not illustrated) included in the printing apparatus 100 slips to match the speeds of conveying the ink ribbon 114 and the print sheet 113. More specifically, the tension applied to the ink ribbon 114 by the rewinding shaft 301 is determined by the slip torque of the torque limiter and the shaft diameter of the ink ribbon 114 on the rewinding shaft 301 side formed by the already rewound ink ribbon 114. As described above, also in the early period of photographic printing, during the photographic printing operation, the torque limiter conveys the ink ribbon 114 while slipping. Therefore, the tension applied to the ink ribbon 114 during the photographic printing operation in the final period of photographic printing illustrated in FIG. 7A has a smaller value than in the early period of photographic printing.

Figure 7B:
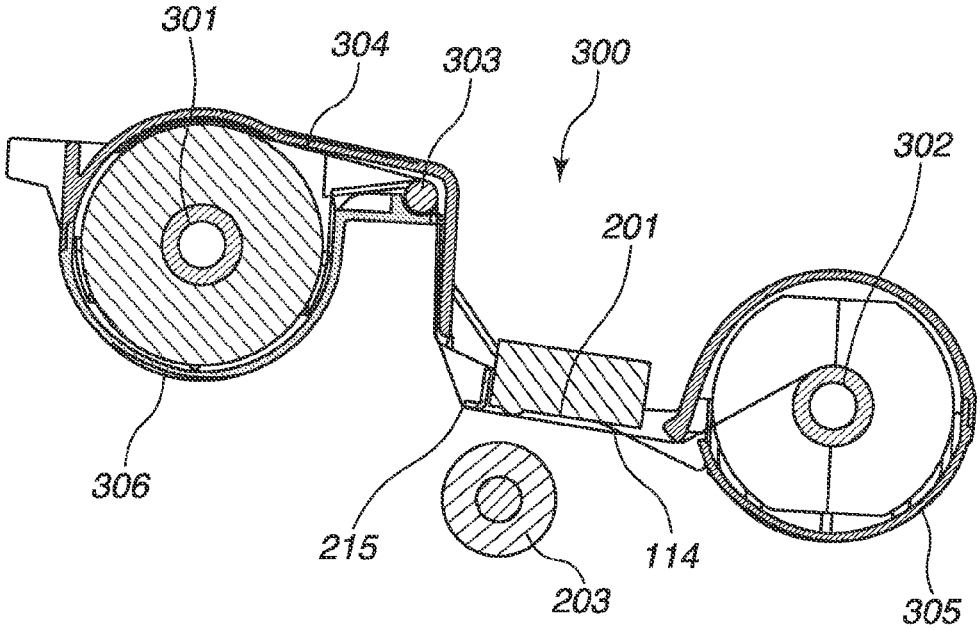

FIG. 7B is a cross-sectional view of the state where the top of the ribbon is positioned using the ink ribbon cassette 300 in the final period of use. Similarly to the ribbon top positioning operation in the early period of photographic printing illustrated in FIG. 6B, the conveyance resistance to the ink ribbon 114 is low. However, the portion of the ink ribbon 114 that has already been used for photographic printing is wound around the rewinding shaft 301. Thus, the shaft diameter of the ink ribbon 114 on the rewinding shaft 301 side, on which the ink ribbon 114 is to be rewound, is larger than in the early period of use of the ink ribbon cassette 300. If the slip torque of the torque limiter (not illustrated) included in the printing apparatus 100 is small, it is not possible to cause sufficient tension because the shaft diameter of the ink ribbon 114 on the rewinding shaft 301 side is large. Thus, it is not possible to rewind the ink ribbon 114. Thus, the slip torque of the torque limiter is adjusted to have a value that enables the rewinding of the ink ribbon 114 in the state of FIG. 7B.

As described above with reference to FIG. 6B, the conveyance resistance to the ink ribbon 114 is caused only by dynamic friction in each portion. If, however, this conveyance resistance is high, it is necessary to increase the slip torque of the torque limiter. This increases the tension that occurs in the ink ribbon 114 in the state of FIG. 6A.

Figure 8:
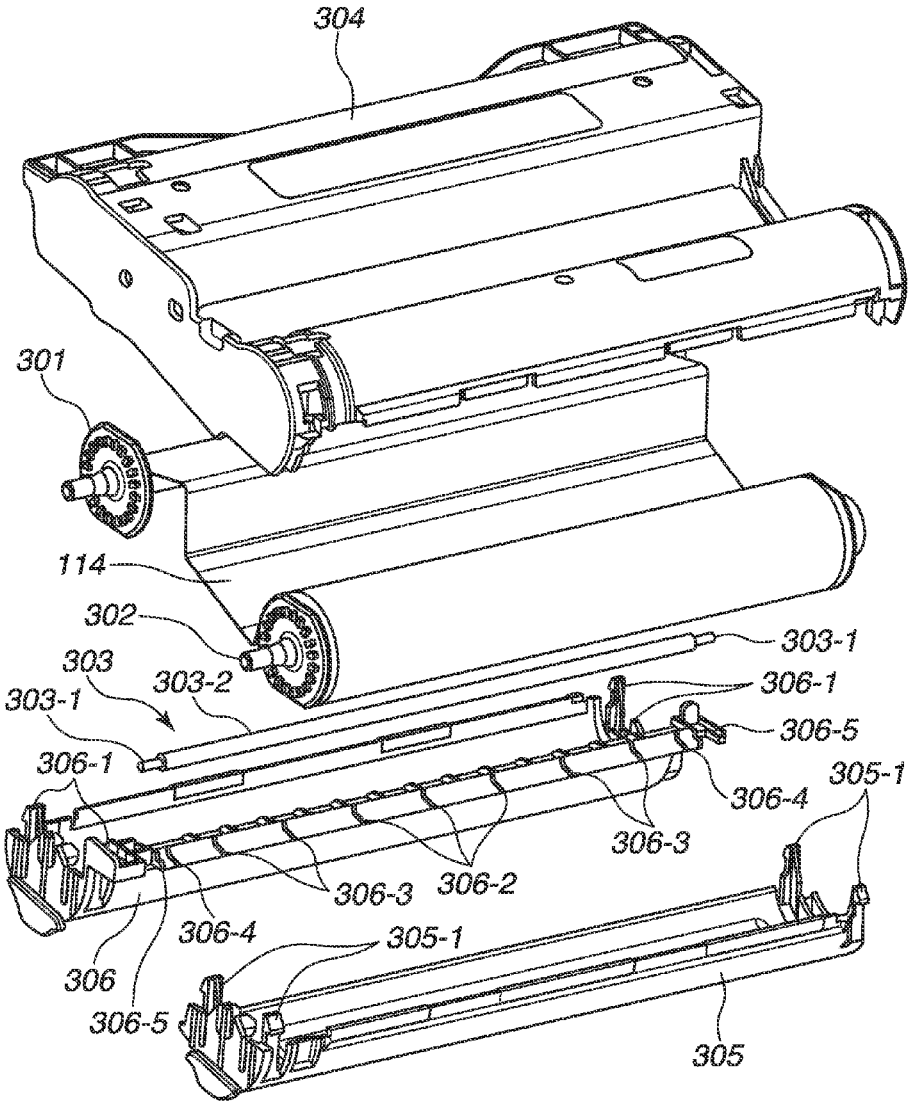
FIG. 8 is an exploded view of the ink ribbon cassette.

Next, with reference to FIGS. 8 to 11C, the details of the configuration of the ink ribbon cassette 300 are described. FIG. 8 is an exploded view of the ink ribbon cassette 300. The ink ribbon 114 is stored in the cassette case 304 such that the ink ribbon 114 is wound around the supply shaft 302 at one end, and the other end is attached to the rewinding shaft 301. The cassette case 304 is formed of a general-purpose molded material such as acrylonitrile butadiene styrene (ABS), or an engineering plastic such as polycarbonate (PC). The rewinding shaft 301 and the supply shaft 302 are similar components and are injection-molded products using a highly slidable material made of a general-purpose resin such as ABS or polystyrene (PS). The cassette case 304 is shaped into two general semicylinders connected together. A supply-side case 305 and a rewinding-side case 306 cover the respective semicylinders to form nearly a cylindrical shape. The supply-side case 305 and the rewinding-side case 306 are engaged with the cassette case 304 by supply-side case engaging claws 305-1 and rewinding-side case engaging claws 306-1, respectively, and integrated with the cassette case 304. Further, the supply-side case 305 and the rewinding-side case 306 are injection-molded resin products similar to the cassette case 304. The supply shaft 302 and the rewinding shaft 301 are placed in the general cylinder formed by the cassette case 304, the supply-side case 305, and the rewinding-side case 306, and are rotatably supported. The ink ribbon 114 slides in contact with the supply-side sliding portion 304-1 and the rewinding-side sliding portion 304-2, which are provided in the cassette case 304, and is curved at the guide shaft 303, which is rotatably supported by the cassette case 304. The ink ribbon 114 is placed to pass through an opening portion provided between the supply-side case 305 and the rewinding-side case 306, and the cassette case 304, and to take a path illustrated in FIGS. 6A to 7B. The guide shaft 303 is produced by the injection molding of polybutylene terephthalate containing 30% of glass fiber (PBT-G 30%), which is a high-strength resin. The guide shaft 303 includes a larger diameter portion 303-2, which comes into contact with the ink ribbon 114, and smaller diameter portions 303-1, which are provided coaxially with the larger diameter portion 303-2 at both ends of the larger diameter portion 303-2. The rewinding-side case 306 includes first regulation portions 306-2, second regulation portions 306-3, and third regulation portions 306-4, each of which is shaped into a plurality of ribs in the axial direction of the guide shaft 303, and guide shaft regulation portions 306-5, on approximately the opposite side of the ink ribbon 114 across the guide shaft 303.

Figure 9:
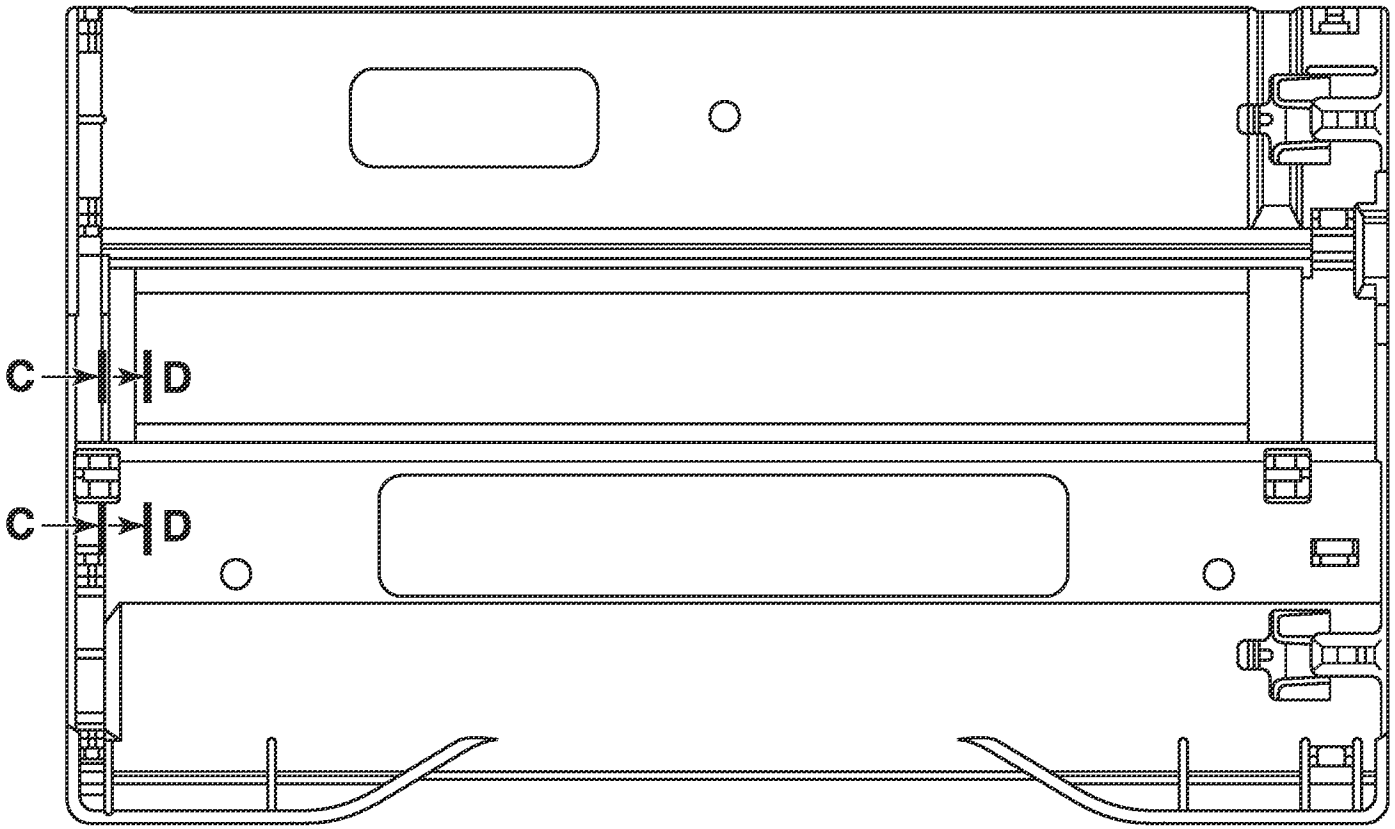
FIG. 9 is a top view of the ink ribbon cassette.
Figure 10A:
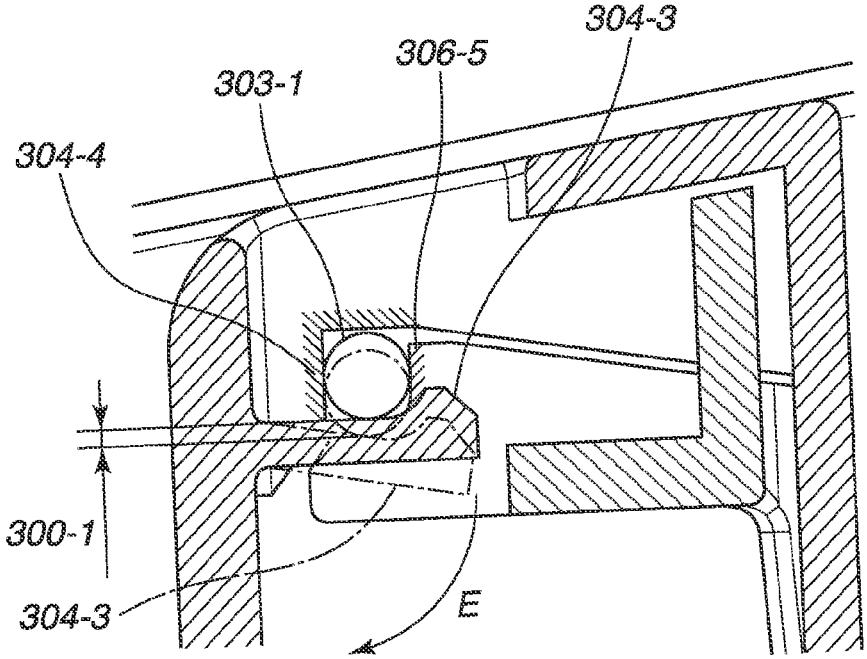
FIGS. 10A and 10B are cross-sectional views of portions near a guide shaft of the ink ribbon cassette.
Figure 10B:
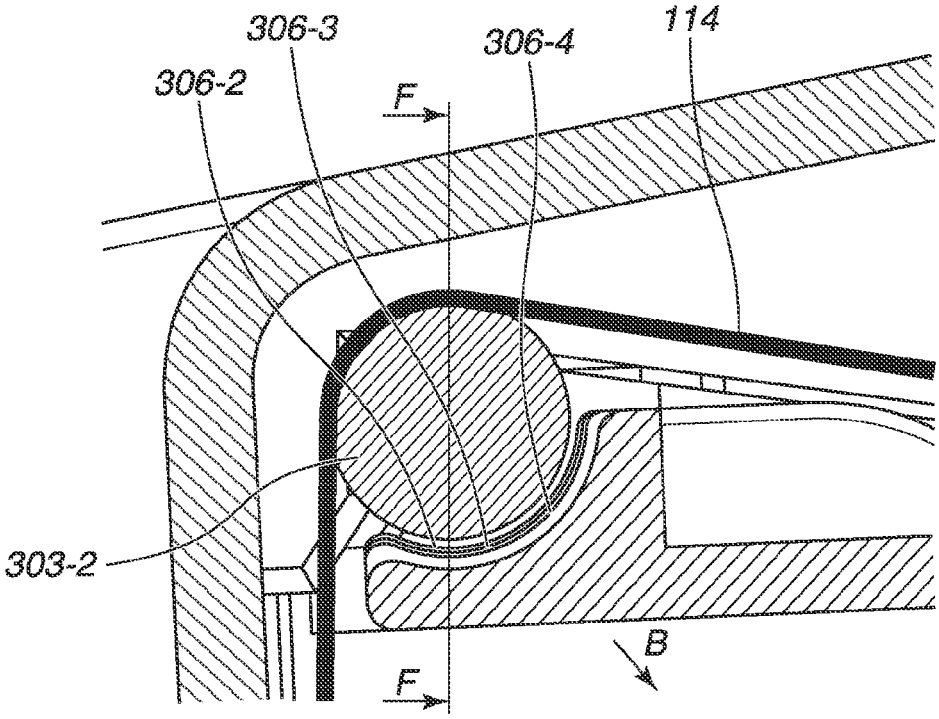

FIG. 9 is a top view of the ink ribbon cassette 300. FIGS. 10A and 10B are cross-sectional views of portions near the guide shaft 303 when viewed along lines C-C and D-D, respectively, indicated in FIG. 9. At the position illustrated in FIG. 10A, a guide shaft reception portion 304-3, which rotatably holds the smaller diameter portion 303-1 of the guide shaft 303, is provided in the cassette case 304. The guide shaft reception portion 304-3 is formed of a resin and shaped into a thin cantilever plate. The guide shaft reception portion 304-3 has a structure that is elastically deformable in the direction indicated by an arrow E in FIG. 10A. Near the smaller diameter portion 303-1, guide shaft regulation portions 304-4 and 306-5, which regulate the position of the shaft 303 in the rotational direction, are provided in the rewinding-side case 306 and the cassette case 304. The reason why the smaller diameter portion 303-1 is provided in the guide shaft 303 and the guide shaft 303 is rotatably supported at the smaller diameter portions 303-1, is that this structure can make the rotational sliding resistance low relative to the rotational moment applied to the larger diameter portion 303-2 by the ink ribbon 114. The conveying path of the ink ribbon 114 is sharply curved at the guide shaft 303. Thus, if the rotational movement resistance of the guide shaft 303 is high, the force required to convey the ink ribbon 114 increases. As described above, a thermal transfer printing apparatus performs printing by nipping and conveying an ink ribbon and a print sheet while applying heat to the ink ribbon. Thus, the ink ribbon is damaged by heat. At this time, if the ink ribbon has been pulled by greater force, wrinkles and twists may occur in the ink ribbon having deteriorated by the thermal damage. This may reduce the photographic printing quality.

The guide shaft regulation portions 304-4 and 306-5 are integrated with the cassette case 304 and the rewinding-side case 306, respectively, and shaped into ribs. The guide shaft regulation portions 304-4 and 306-5 regulate the position of the guide shaft 303 in the left, right, and up directions in FIG. 10A with slight clearances between the guide shaft regulation portions 304-4 and 306-5 and the guide shaft 303. In the present exemplary embodiment, each of the clearances in the left, right, and up directions is 0.2 mm. In the down direction (the direction of the arrow E in FIG. 10A), a relatively large clearance 300-1 is provided. Thus, the guide shaft 303 is configured to move downward if the guide shaft reception portion 304-3 deforms in the direction E as indicated by a dashed-dotted line in FIG. 10A. In the present exemplary embodiment, the clearance between the smaller diameter portion 303-1 and the guide shaft regulation portion 306-5 in the down direction is set to 0.5 mm. As illustrated in FIG. 10A, the guide shaft reception portion 304-3 has nearly a cantilever shape and supports the guide shaft 303 at a position close to the free end side. In the state where the guide shaft reception portion 304-3 is not deformed, the position of the guide shaft 303 in the rotational direction is regulated such that the guide shaft 303 is rotatably supported by the guide shaft regulation portions 304-4 and 306-5 and the guide shaft reception portion 304-3. More specifically, in the situation where, as illustrated in FIG. 6A, the load applied to the guide shaft 303 is so great that the ink ribbon 114 pushes into the guide shaft 303 in the direction indicated by the arrow B in FIG. 6A, the guide shaft reception portion 304-3 bends in the direction E as indicated by the dashed-dotted line in FIG. 10A. Then, the guide shaft 303 is configured to move in the down direction, that is, downward along the guide shaft regulation portion 306-5.

At the position illustrated in FIG. 10B, the larger diameter portion 303-2 of the guide shaft 303 curves the ink ribbon 114 to guide the conveyance of the ink ribbon 114. The first, second, and third regulation portions 306-2, 306-3, and 306-4 provided in the rewinding-side case 306 are placed with a different clearance between each portion and the larger diameter portion 303-2 of the shaft 303. Each of the first regulation portions 306-2 provided near a center portion of the guide shaft 303 is shaped into ribs each having an arc shape concentric with the guide shaft 303 and has an extremely small clearance between the first regulation portion 306-2 and the guide shaft 303. In the present exemplary embodiment, the clearance between each of the first regulation portions 306-2 and the larger diameter portion 303-2 is set to 0.1 mm. As illustrated in FIG. 8, the three first regulation portions 306-2 are provided symmetrically in the center portion of the shaft 303. The second regulation portions 306-3 are provided slightly away from the center portion of the guide shaft 303 and symmetrically in the axial direction. Each of the second regulation portions 306-3 is shaped into ribs each having an arc shape concentric with the guide shaft 303, similarly to the first regulation portions 306-2. The clearance between each of the second regulation portions 306-3 and the larger diameter portion 303-2 is set to 0.15 mm, and two second regulation portions 306-3 are placed on the left and right, respectively, therefore, the four second regulation portions 306-3 in total. Further, the third regulation portions 306-4 are provided further away from the center portion of the guide shaft 303 and symmetrically in the axial direction. Each of the third regulation portions 306-4 is shaped into ribs, similarly to the second regulation portions 306-3. The clearance between each of the third regulation portions 306-4 and the larger diameter portion 303-2 is set to 0.20 mm, and the two third regulation portions 306-4 are placed on the left and right near the ends of the shaft 303.

Figure 11A:
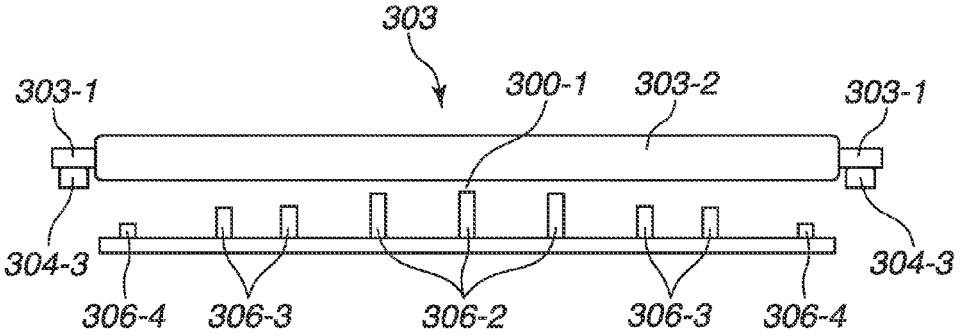
FIGS. 11A, 11B, and 11C are diagrams illustrating the configuration of the guide shaft of the ink ribbon cassette and a portion near the guide shaft.
Figure 11B:
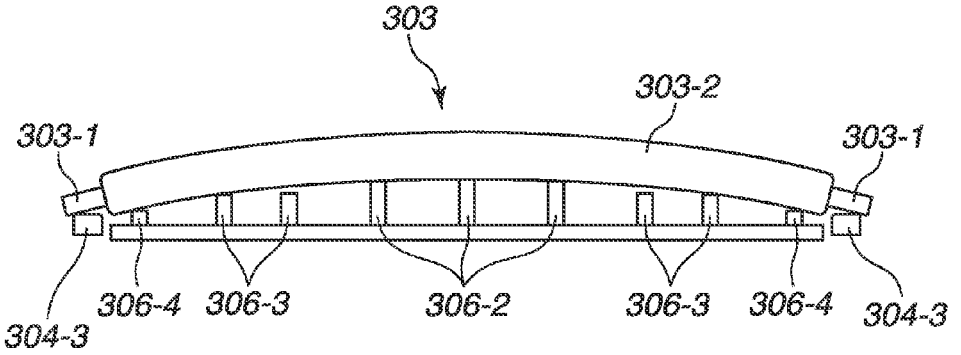
Figure 11C:
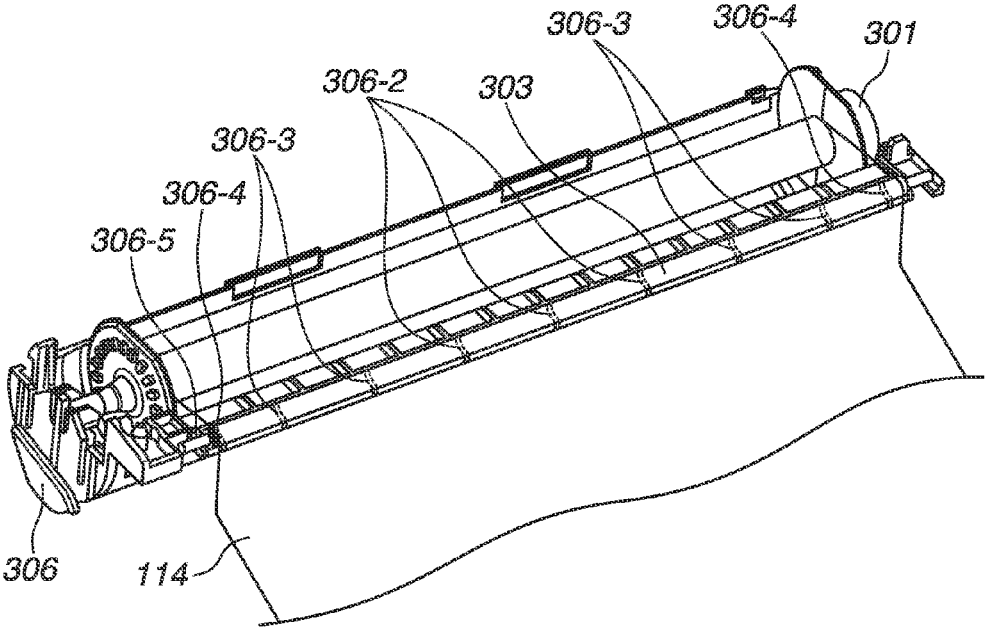

FIGS. 11A and 11B are cross-sectional views along a line F-F in FIG. 10B. FIGS. 11A and 11B are diagrams exaggerating the state where the tension applied to the ink ribbon 114 is small and the state where the tension applied to the ink ribbon 114 is great, respectively, for illustrative purposes. Further, FIG. 11C is a simplified view of a portion near the guide shaft 303. In FIG. 11C, the cassette case 304 is omitted, and the first, second, and third regulation portions 306-2, 306-3, and 306-4 are indicated by dotted lines for illustrative purposes. As illustrated in FIG. 11C, the width of the ink ribbon 114 is approximately equal to the length of the larger diameter portion 303-2 of the guide shaft 303. More specifically, if the tension applied to the ink ribbon 114 is great, approximately the entire area of the larger diameter portion 303-2 of the guide shaft 303 is subjected to a load.

As illustrated in FIG. 6B or 7B, in the situation where the tension that occurs in the ink ribbon 114 is small, the force of bending the guide shaft 303 and the guide shaft reception portions 304-3 hardly occurs. Thus, as illustrated in FIG. 11A, the clearance 300-1 is secured even above the first regulation portions 306-2 that are closest to the guide shaft 303. This does not cause high conveyance resistance. Further, the guide shaft 303 maintains a linear cylindrical shape and therefore can guide the entire surface of the ink ribbon 114 in the width direction. This enables the guide shaft 303 to stably convey the ink ribbon 114.

As illustrated in FIG. 6A, if great tension has occurred in the ink ribbon 114, the force of moving the guide shaft 303 is applied in the direction of an arrow B indicated in FIG. 10B.

As illustrated in FIG. 11B, if the shaft reception portions 304-3 have been pressed by the guide shaft 303 and have bent, the position of the guide shaft 303 moves. Consequently, first, the first regulation portions 306-2 and the guide shaft 303, which are placed with the smallest clearance 300-1 therebetween, start coming into contact with each other. If the shaft reception portions 304-3 have further bent, the guide shaft 303, which is being pressed over approximately the entire length by the ink ribbon 114, further moves and abuts the second and third regulation portions 306-3 and 306-4. In this case, the larger diameter portion 303-2 is subjected to a load. However, the conveying force applied to the ink ribbon 114 by the printing apparatus 100 is great and therefore does not prevent the conveyance of the ink ribbon 114. Further, the center portion of the guide shaft 303 is supported by the first regulation portions 306-2, and both ends of the guide shaft 303 are supported by ribs having a clearance larger than the clearance 300-1, in other words, supported by lower ribs. This causes the guide shaft 303 to protrude toward the ink ribbon 114. Consequently, the ink ribbon 114 is conveyed along the axial direction while stretched from the center portion to both ends. This results in smoothing wrinkles and twists caused by thermal damage from photographic printing.

Further, the guide shaft reception portions 304-3 are formed of elastic members. Thus, if the guide shaft reception portions 304-3 have been pushed in by the ink ribbon 114 and have deformed to the positions illustrated in FIG. 11B, force acts in the directions of returning to the original shapes. If the tension of the ink ribbon 114 has decreased, the restoring force of the guide shaft reception portions 304-3 returning to the original shapes urges the guide shaft 303. Thus, the guide shaft 303 moves in a direction away from the regulation portions 306 and returns to the state of FIG. 11A.

The guide shaft 303 is thus rotatably supported by the elastically deformable shaft reception portions 304-3. Thus, if the stress that occurs in the guide shaft 303 is small, the rotational movement of the guide shaft 303 is allowed only in the shaft reception portions 304-3. This enables the guide shaft 303 to stably guide the entire surface of the ink ribbon 114. Further, if the stress that occurs in the guide shaft 303 is great, the guide shaft 303 is moved. Then, the guide shaft 303 abuts the regulation portions 306-2 to 306-4. Among the regulation portions 306-2 to 306-4, the ribs included in the regulation portions located on the shaft center portion side are formed higher than the ribs included in the regulation portions located on the shaft end portion sides. This causes the guide shaft 303 to protrude toward the ink ribbon 114 side and prevents wrinkles and twists. This enables the guide shaft 303 to stably convey the ink ribbon 114.

In the present exemplary embodiment, the guide shaft 303 is provided in the ink ribbon cassette 300. Alternatively, with a similar configuration, the guide shaft 303 may be provided in a printer body.

Further, in the present exemplary embodiment, the shaft reception portions 304-3 are shaped into cantilevers and configured to be elastically deformable so that the guide shaft 303 is movable. Alternatively, the configuration may be such that the guide shaft 303 moves using another urging method.

Figure 12A:
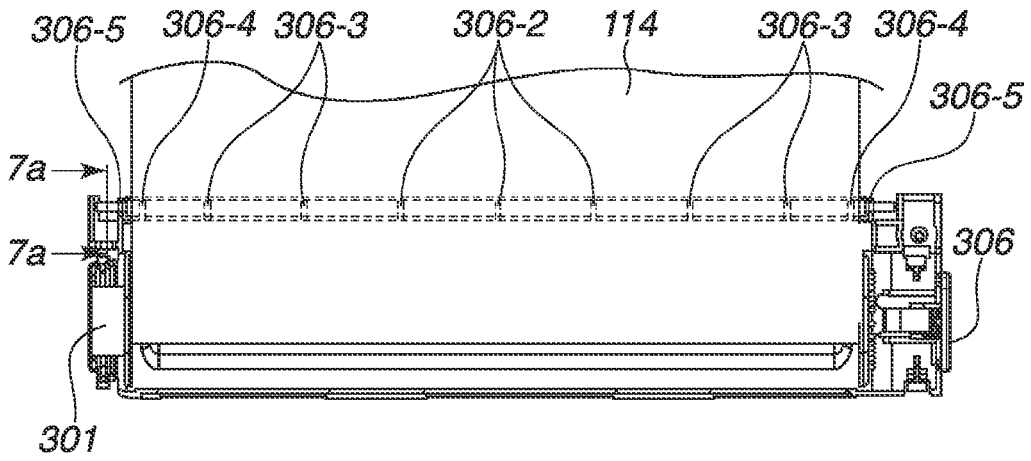
FIGS. 12A and 12B are diagrams illustrating the configuration of the ink ribbon cassette near the guide shaft.
Figure 12B:
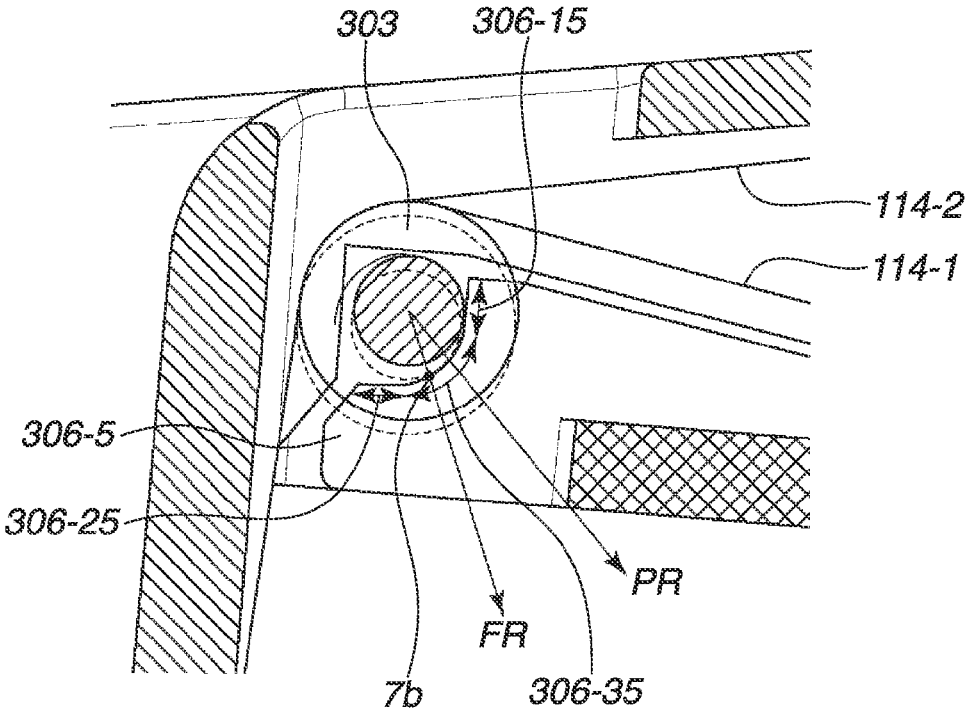

FIGS. 12A and 12B are diagrams illustrating the configuration of the ink ribbon cassette 300 near the guide shaft 303 describing the guide shaft regulation portions 306-5.

FIG. 12A is a diagram illustrating the rewinding-side case 306, the rewinding shaft 301, the ink ribbon 114, and the guide shaft 303 when viewed from the cassette case 304 side, while omitting the cassette case 304. The guide shaft 303 is hidden behind the ink ribbon 114 and therefore is indicated by a dotted line. Further, also the portion of the rewinding-side case 306 near the first, second, and third regulation portions 306-2, 306-3, and 306-4 and the guide shaft regulation portions 306-5 are hidden behind the guide shaft 303 and the ink ribbon 114 and therefore are indicated by a dotted line.

As has been described above, the circumferential force applied to the guide shaft 303 results from the tension of the ink ribbon 114. The maximum value of the tension is basically determined based on the difference between the force of winding up the ink ribbon 114 and the force against the winding up.

For example, if the coefficient of dynamic friction between the back surface of the ink ribbon 114 and the surface of the thermal head 201 is high, the tension that occurs in the ink ribbon 114 increases.

Further, the ink ribbon 114 and the print sheet 113 are nipped and conveyed between the thermal head 201 and the platen roller 203 while the dyes applied to the ink ribbon 114 are transferred onto the print sheet 113 by heat provided by the thermal head 201. Then, the ink ribbon 114 and the print sheet 113 are peeled off from each other by the peel-off plate 215. To obtain a high-density image, the amount of heat to be provided to the ink ribbon 114 by the thermal head 201 increases. At this time, the sticking force between the ink ribbon 114 and the print sheet 113 increases, and the force of peeling off the ink ribbon 114 and the print sheet 113 from each other by the peel-off plate 215 increases. More specifically, if a high-density image has been printed, the sticking force between the ink ribbon 114 and the print sheet 113 increases, and the conveyance resistance of the ink ribbon 114 increases.

As illustrated in FIG. 12A, the third regulation portions 306-4 are placed slightly within the full width of the ink ribbon 114. Further, the length of the larger diameter portion 303-2 of the guide shaft 303 is slightly greater than the full width of the ink ribbon 114. This configuration is taken to minimize the sizes of the members included in the ink ribbon cassette 300, such as the ink ribbon 114 and the guide shaft 303, while taking into account the manufacturing tolerances of the members, thereby downsizing the ink ribbon cassette 300.

FIG. 12B is a cross-sectional view along a line 7*a*-7*a* in FIG. 12A. FIG. 12B illustrates the state of an ink ribbon 114-1 immediately after the beginning of use of the ink ribbon cassette 300, and the state of an ink ribbon 114-2 immediately before the end of use of the ink ribbon cassette 300 for illustrative purposes. Further, the guide shaft 303 before moving by the tension of the ink ribbon 114 is indicated by a solid line, including the portion hidden behind the guide shaft regulation portion 306-5. Further, the guide shaft 303 after the movement is indicated by a dotted line, including the portion that is not hidden behind the guide shaft regulation portion 306-5. As illustrated in FIG. 11B, the guide shaft 303 moves under the tension of the ink ribbon 114, and the guide shaft reception portion 304-3 bends. As described above, however, the tension that occurs in the ink ribbon 114 also increases or decreases depending on the image to be printed. More specifically, the larger the area of the high gradation portion of the image, the greater the force required to peel off the ink ribbon 114 from the print sheet 113. This results in increasing the tension that occurs in the ink ribbon 114. If very great force is applied to the guide shaft 303, the part of the guide shaft 303 outside the third regulation portion 306-4 is further moved, that is, the part near the smaller diameter portion 303-1, which is an end portion of the guide shaft 303.

If the guide shaft 303 moves a predetermined distance or more, the smaller diameter portion 303-1 abuts the guide shaft regulation portion 306-5 to regulate the position of the guide shaft 303. The guide shaft regulation portion 306-5 is formed in the rewinding-side case 306 in an integrated manner. The guide shaft regulation portion 306-5 includes a portion 306-15, which regulates the rightward movement of the smaller diameter portion 303-1 in FIG. 12B, a portion 306-25, which regulates the downward movement of the smaller diameter portion 303-1, and a portion 306-35, which connects both portions 306-15 and 306-25 to form an arc shape. The inner diameter of the arc shape 306-35 is greater than the outer diameter of the smaller diameter portion 303-1 of the shaft 303. In the present exemplary embodiment, the outer diameter of the smaller diameter portion 303-1 is 1.20 mm, and the inner diameter of the arc shape 306-35 is 1.50 mm. As illustrated in FIGS. 6A and 7A, downstream of the guide shaft 303, the ink ribbon 114 is rewound around the rewinding shaft 301, and the shaft diameter of the ink ribbon 114 on the rewinding shaft 301 side changes, thereby changing the conveying path of the ink ribbon 114 from 114-1 to 114-2. Thus, the vector of the force applied to the guide shaft 303 by the tension of the ink ribbon 114 changes from the direction indicated by an arrow FR to the direction indicated by an arrow PR in FIG. 12B.

The vector indicated by the arrow FR shows the direction of the force that is applied to the guide shaft 303 immediately after the beginning of use of the ink ribbon cassette 300, in the state where little amount of the ink ribbon 114 is wound around the rewinding shaft 301 and the shaft diameter of the ink ribbon 114 on the rewinding shaft 301 side is small. If predetermined force or more has been applied in the direction of moving the guide shaft 303 under the tension of the ink ribbon 114, the guide shaft 303 abuts the guide shaft regulation portion 306-5 to regulate the position of the guide shaft 303 as described above.

The vector indicated by the arrow PR shows the direction of the force that is applied to the guide shaft 303 in the final period of use of the ink ribbon cassette 300, in the state where a large amount of the ink ribbon 114 is wound around the rewinding shaft 301 and the shaft diameter of the ink ribbon 114 on the rewinding shaft 301 side is large. As the shaft diameter of the ink ribbon 114 wound up around the rewinding shaft 301 side increases, the tension applied to the ink ribbon 114 decreases. Due to a factor such as the characteristics of the image as described above, however, great force may also be applied to the guide shaft 303 in the direction indicated by the arrow PR. Even in the final period of use of the ink ribbon cassette 300, if great force has been applied to the guide shaft 303, the guide shaft 303 moves, and the smaller diameter portion 303-1 of the guide shaft 303 abuts the guide shaft regulation portion 306-5 to regulate the position of the guide shaft 303.

The size of the arc shape 306-35 is set so that regardless of whether the force applied by the ink ribbon 114 shows the direction of the arrow FR or the direction of the arrow PR, the smaller diameter portion 303-1 of the guide shaft 303 abuts the arc shape 306-35 of the guide shaft regulation portion 306-5 after the movement of the guide shaft 303. In other words, the size of the arc shape 306-35 is set to contain the vectors indicated by the arrow FR and the arrow PR.

The arc shape 306-35 as described above is set in order that the guide shaft 303 abuts the shaft regulation portion 306-5 at one point. For example, if the force is acting in the direction of the arrow FR, the guide shaft 303 abuts the shaft regulation portion 306-5 at a point 7*b* on the arc shape 306-35. This is because the inner diameter of the arc shape 306-35 of the shaft regulation portion 306-5 is larger than the outer diameter of the smaller diameter portion 303-1 of the guide shaft 303.

More specifically, during the use of the ink ribbon cassette 300, even if the direction of the force applied by the ink ribbon 114 has changed from the direction of the arrow FR to the direction of the arrow PR, the smaller diameter portion 303-1 of the guide shaft 303 always abuts the arc shape 306-35 between the direction of the arrow FR and the direction of the arrow PR. Thus, during the use of the ink ribbon cassette 300, even if the shaft diameter of the ink ribbon 114 on the rewinding shaft 301 side has changed, the smaller diameter portion 303-1 of the guide shaft 303 abuts the guide shaft regulation portion 306-5 at one point.

If the guide shaft regulation portion 306-5 does not have the arc shape 306-35, or if the shaft diameter of the ink ribbon 114 on the rewinding shaft 301 side has changed but the smaller diameter portion 303-1 does not abut the arc shape 306-35, or if the inner diameter of the arc shape 306-35 of the guide shaft regulation portion 306-5 is smaller than the outer diameter of the smaller diameter portion 303-1 of the guide shaft 303, the smaller diameter portion 303-1 abuts the guide shaft regulation portion 306-5 simultaneously at two points. If the smaller diameter portion 303-1 has come into contact with the guide shaft regulation portion 306-5 at two points, resistance against the rotational movement of the guide shaft 303 changes depending on the abutting state of the guide shaft regulation portion 306-5. This may prevent the guide shaft 303 from stably conveying the ink ribbon 114. In contrast, the guide shaft regulation portion 306-5 according to the present exemplary embodiment abuts the smaller diameter portion 303-1 at one point and therefore stabilizes the rotational movement resistance of the guide shaft 303. This enables the guide shaft 303 to stably convey the ink ribbon 114.

In the present exemplary embodiment, the guide shaft regulation portions 306-5 are provided in the rewinding-side case 306. Alternatively, with a similar configuration, the guide shaft regulation portions 306-5 may be provided in a printer body or in the cassette case 304.

While the desirable exemplary embodiments of the present invention have been described, the present invention is not limited to these exemplary embodiments, but can be modified and changed in various manners within the scope of the invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-138334 filed Jul. 1, 2013, which is hereby incorporated by reference herein in its entirety.

What is claimed is:

1. An ink ribbon cassette comprising:

a supply shaft around which an ink ribbon is wound;

a rewinding shaft around which the ink ribbon from the supply shaft is to be rewound;

a guide shaft configured to abut the ink ribbon on a conveying path of the ink ribbon from the supply shaft to the rewinding shaft; and a regulation portion configured to abut the guide shaft according to a force applied to the guide shaft by the ink ribbon, thereby deforming the guide shaft to protrude toward the ink ribbon side.

2. The ink ribbon cassette according to claim 1, further comprising a shaft reception portion configured to support the guide shaft, wherein the shaft reception portion is configured such that the guide shaft is movable according to the force applied by the ink ribbon.

3. The ink ribbon cassette according to claim 2, wherein the shaft reception portion is configured such that the guide shaft moves to the regulation portion side under tension applied to the ink ribbon when the ink ribbon is conveyed.

4. The ink ribbon cassette according to claim 3, wherein, if the tension applied to the ink ribbon is small, the guide shaft is held at a position where the guide shaft does not abut the regulation portion.

5. The ink ribbon cassette according to claim 3, wherein the shaft reception portion is configured to urge the guide shaft, in a direction away from the regulation portion.

6. The ink ribbon cassette according to claim 2, wherein the shaft reception portion is formed of an elastic member.

7. The ink ribbon cassette according to claim 1, wherein the regulation portion includes a plurality of ribs having different heights, and wherein the ribs that abut a center portion of the guide shaft are formed higher than the ribs that abut end portions of the guide shaft.

8. The ink ribbon cassette according to claim 1, wherein the guide shaft is provided on the rewinding shaft side on the conveying path of the ink ribbon.

9. The ink ribbon cassette according to claim 1, wherein the guide shaft curves the conveying path of the ink ribbon.

10. The ink ribbon cassette according to claim 1, wherein the regulation portion has an arc-shaped area which abuts the guide shaft when the guide shaft has moved against the regulation portion.

11. The ink ribbon cassette according to claim 10, wherein an inner diameter of the arc shape is greater than an outer diameter of a portion of the guide shaft that abuts the guide shaft regulation portion.

12. The ink ribbon cassette according to claim 1, wherein the regulation portion deforms the guide shaft to protrude toward a point of contact with the ink ribbon.

13. A printing apparatus comprising:

a supply shaft around which an ink ribbon is wound;

a rewinding shaft around which the ink ribbon from the supply shaft is to be rewound;

a guide shaft configured to abut the ink ribbon on a conveying path of the ink ribbon from the supply shaft to the rewinding shaft; and a regulation portion configured to abut the guide shaft according to a force applied to the guide shaft by the ink ribbon, thereby deforming the guide shaft to protrude toward the ink ribbon side.

14. The printing apparatus according to claim 13, further comprising a shaft reception portion configured to support the guide shaft, wherein the shaft reception portion is configured such that the guide shaft is movable according to the force applied by the ink ribbon.

15. The printing apparatus according to claim 14, wherein the shaft reception portion is configured such that the guide shaft moves to the regulation portion side under tension applied to the ink ribbon when the ink ribbon is conveyed.

16. The printing apparatus according to claim 13, wherein, if the tension applied to the ink ribbon is small, the guide shaft is held at a position where the guide shaft does not abut the regulation portion.

17. The printing apparatus according to claim 15, wherein the shaft reception portion is configured to urge the guide shaft, in a direction away from the regulation portion.

18. The printing apparatus according to claim 14, wherein the shaft reception portion is formed of an elastic member.

19. The printing apparatus according to claim 13, wherein the regulation portion includes a plurality of ribs having different heights, and wherein the ribs that abut a center portion of the guide shaft are formed higher than the ribs that abut end portions of the guide shaft.

20. The printing apparatus according to claim 13, wherein the guide shaft is provided on the rewinding shaft side on the conveying path of the ink ribbon.

21. The printing apparatus according to claim 13, wherein the guide shaft curves the conveying path of the ink ribbon.

22. The printing apparatus according to claim 13, wherein the regulation portion abuts the guide shaft, thereby deforming the guide shaft to protrude toward the ink ribbon side.

23. The printing apparatus according to claim 20, further comprising:

a thermal head and a platen roller provided at a position opposed to the thermal head;

an ink ribbon conveyance unit configured to rotate the rewinding shaft to convey the ink ribbon; and a sheet conveyance unit configured to convey a sheet, wherein, when an ink of the ink ribbon is transferred onto the sheet, the ink ribbon conveyance unit conveys the ink ribbon and the sheet conveyance unit conveys the sheet while the thermal head and the platen roller nip the sheet and the ink ribbon, and the guide shaft is provided closer to the rewinding shaft on the conveying path of the ink ribbon than the thermal head is.

24. The printing apparatus according to claim 13, wherein the regulation portion has an arc-shaped area which abuts the guide shaft when the guide shaft has moved against the regulation portion.

25. The printing apparatus according to claim 24, wherein an inner diameter of the arc shape is greater than an outer diameter of a portion of the guide shaft that abuts the guide shaft regulation portion.

26. The printing apparatus according to claim 13, wherein the regulation portion deforms the guide shaft to protrude toward a contact point with the ink ribbon.

* * * * *